US006499409B1

(12) United States Patent
Niederer et al.

(10) Patent No.: US 6,499,409 B1
(45) Date of Patent: Dec. 31, 2002

(54) PNEUMATIC PROPULSION TRACK APPARATUS

(76) Inventors: Eric Niederer, 5091 Woodrun on Tillery, Mt. Gilead, NC (US) 27306; Lee Niederer, 5091 Woodrun on Tillery, Mt. Gilead, NC (US) 27306

( * ) Notice: Subject to any disclaimer, the term of this patent is extended or adjusted under 35 U.S.C. 154(b) by 0 days.

(21) Appl. No.: 10/037,520

(22) Filed: Jan. 3, 2002

(51) Int. Cl.[7] ..... B61B 13/10
(52) U.S. Cl. ..... 104/138.1; 463/64
(58) Field of Search ..... 104/138.1, 155, 104/165, 168, 154, 156; 463/60, 64; 446/197

(56) References Cited

U.S. PATENT DOCUMENTS

| | | | | |
|---|---|---|---|---|
| 2,128,690 A | | 8/1938 | Burke et al. | 35/40 |
| 2,571,081 A | | 10/1951 | Wilson | 273/86 |
| 2,630,320 A | | 3/1953 | Francis | 273/86 |
| 2,703,687 A | * | 3/1955 | Prietzel | 104/138.1 |
| 3,104,078 A | * | 9/1963 | Buchwald et al. | 406/110 |
| 3,224,771 A | | 12/1965 | Altieri | 273/86 |
| 3,466,043 A | | 9/1969 | McRoskey et al. | 273/86 |
| 3,469,340 A | * | 9/1969 | Breneman et al. | 446/197 |
| 3,630,524 A | | 12/1971 | Cooper et al. | 273/86 R |
| 3,643,953 A | | 2/1972 | Fixler | 273/119 B |
| 3,697,071 A | | 10/1972 | Anderson | 273/86 D |
| 3,797,405 A | * | 3/1974 | Carstens et al. | 104/138.1 |
| 3,999,487 A | * | 12/1976 | Valverde | 104/138.1 |
| 4,070,024 A | | 1/1978 | Hamano | 273/86 D |
| 4,091,562 A | | 5/1978 | Kimura | 46/44 |
| 4,202,272 A | * | 5/1980 | Teodorescu et al. | 104/138.1 |
| 4,209,935 A | | 7/1980 | Parker | 46/44 |
| 4,229,005 A | | 10/1980 | Barlow et al. | 273/86 D |
| 4,283,053 A | | 8/1981 | Parker et al. | 273/86 D |
| 4,458,602 A | | 7/1984 | Vandersteel | 104/138.1 |
| 4,725,256 A | | 2/1988 | Sassak | 446/176 |
| 4,925,188 A | | 5/1990 | McKay et al. | 273/86 R |
| 4,963,116 A | | 10/1990 | Huber | 446/176 |
| 5,193,462 A | * | 3/1993 | Marcu | 104/138.1 |
| 5,253,590 A | * | 10/1993 | Marusak | 104/138.1 |
| 5,326,301 A | | 7/1994 | Woodside | 446/176 |
| 5,441,434 A | | 8/1995 | Caulkins | 446/130 |
| 5,538,453 A | | 7/1996 | Johnson | 446/176 |
| 5,584,614 A | | 12/1996 | Aidlin et al. | 406/88 |
| 5,651,736 A | | 7/1997 | Myers | 463/64 |
| 5,653,175 A | * | 8/1997 | Milligan | 104/138.1 |
| 5,658,198 A | | 8/1997 | Nagasaka et al. | 463/64 |
| 6,062,773 A | | 5/2000 | Ouellette | 406/88 |
| 6,089,951 A | | 7/2000 | Ostendorff | 446/429 |

* cited by examiner

*Primary Examiner*—S. Joseph Morano
*Assistant Examiner*—Lars A. Olson
(74) *Attorney, Agent, or Firm*—Sperry, Zoda & Kane

(57) ABSTRACT

An apparatus for propelling an object by pneumatic air flow along one or more individual track sections utilizing a unique air controller providing a conduit for entrance of the object thereinto and an exit as well as a switching means for moving the object from one track to another and for maintaining uniform flow such that the object continuously moves through the tracks and the tunnel defined in the air controller therefore. The design includes a unique directional flow tapered air inlet for receiving air under pressure from an air pressure chamber for the main powering pneumatically of an object through the propulsion track. Also included is a uniquely configured object which may include a decorative body externally thereon for aesthetics. An air recycling chamber is included for minimizing the effects of back pressure and maximizing efficiency of operation of the object. This device could be used for amusement purposes or commercial purposes. It also includes a variable air input control for the main blower for customizing the action thereof based upon the parameters of the pneumatic track and object being utilized.

23 Claims, 10 Drawing Sheets

PNEUMATIC PROPULSION TRACK APPARATUS

BACKGROUND OF THE INVENTION

1. Field of the Invention

The present invention pertains generally to the field of track mounted devices. Such devices historically have primarily comprised trains mounted on tracks. Such designs can be utilized for advertising, monitoring or amusement or as play things for young and old alike. They can be used commercially for advertising and attention gathering. They can be used for side-by-side racing when more than one individual tracks are provided adjacent one another. They can be formed in planer 2-dimensional arrangements similar to train track designs or can be configured with track segments in three dimensions similar to a roller coaster. The same blower can be utilized to provide pressurized air to both tracks to save on expenses and to equalize such competition. More particularly the present invention deals with a pneumatic track powered by pressurized air flow therethrough for moving of an object therealong as desired through one or more track sections. The present invention provides a unique system for controlling the movement of the object and maintaining fully effective and efficient operation thereof.

2. Description of the Prior Art

Numerous prior art devices have been patented for various track related and particularly pneumatically powered track related device which are distinguishable from the present invention such as U.S. Pat. No. 2,128,690 patented Aug. 30, 1938 to M. L. Burke et al on a "Pneumatically Operated Educational Game"; and U.S. Pat. No. 2,571,081 patented Oct. 9, 1951 to J. C. Wilson on a "Pneumatic Racing Game Apparatus"; and U.S. Pat. No. 2,630,320 patented Mar. 3, 1953 to R. N. Francis on a "Racing Game Device"; and U.S. Pat. No. 3,224,771 patented Dec. 21, 1965 to F. A. Altieri and assigned one-half to Charles Trivinia on a "Fluid Pressure Drive Racing Game Apparatus"; and U.S. Pat. No. 3,466,043 patented Sep. 9, 1969 to L. H. McRoskey et al and assigned to Republic Tool & Manufacturing Corp. on "Combined Passing Race Track And Self-Propelled Vehicles"; and U.S. Pat. No. 3,630,524 patented Dec. 28, 1971 to J. Cooper et al on a "Racing Game With Selectively Actuated Lane Switching Members"; and U.S. Pat. No. 3,643,953 patented Feb. 22, 1972 to J. S. Fixler and assigned to Industrial Patent Development Corp. on a "Fluid Pressure Operated Game"; and U.S. Pat. No. 3,697,071 patented Oct. 10, 1972 to J. E. Anderson on a "Fluid Actuated Track System With Constant Flow Valve"; and U.S. Pat. No. 4,070,024 patented Jan. 24, 1978 to N. Hamano and assigned to Tomy Kogyo Co., Inc. on a "Continuous Racetrack Having Vehicle Accelerating Device"; and U.S. Pat. No. 4,091,562 patented May 30, 1978 to C. Kimura and assigned to Okuma Seisakusho Co. Ltd. on a "Toy Railway System"; and U.S. Pat. No. 4,209,935 patented Jul. 1, 1980 to H. Parker on an "Apparatus For Rocket Sled Game"; and U.S. Pat. No. 4,229,005 patented Oct. 21, 1980 to G. A. Barlow et al and assigned to Gordon Barlow Design on a "Track Racing Game"; and U.S. Pat. No. 4,283,053 patented Aug. 11, 1981 to H. Parker et al on an "Air Powered Rocket Sled Game"; and U.S. Pat. No. 4,458,602 patented Jul. 10, 1984 to W. Vandersteel on a "Pneumatic Pipeline Transport System"; and U.S. Pat. No. 4,725,256 patented Feb. 16, 1988 to J. J. Sassak on a "Pneumatic Construction Game"; and U.S. Pat. No. 4,925,188 patented May 15, 1990 to R. S. McKay et al on a "Toy Race Track And Lap Counter"; and U.S. Pat. No. 4,963,116 patented Oct. 16, 1990 to J. J. Huber on a "Race Water Track Toy"; and U.S. Pat. No. 5,326,301 patented Jul. 5, 1994 to J. C. Woodside on an "Air Propelled Toy Dragster Car"; and U.S. Pat. No. 5,441,434 patented Aug. 15, 1995 to K. B. Caulkins on a "Magnetic Conveyance System"; and U.S. Pat. No. 5,538,453 patented Jul. 23, 1996 to L. G. Johnson on an "Air Pressure Toy Rocket Launcher"; and U.S. Pat. No. 5,584,614 patented Dec. 17, 1996 to S. H. Aidlin et al on an "Air Handling System For A Pneumatic Conveyor"; and U.S. Pat. No. 5,651,736 patented Jul. 29, 1997 to J. D. Myers on a "Racer Toy Utilizing Water-Driven Boats"; and U.S. Pat. No. 5,658,198 patented Aug. 19, 1997 to Y. Nagasaka et al and assigned to Imagic, Inc. and Tomy Co., Ltd. on a "Pneumatic Running Toy"; and U.S. Pat. No. 6,062,773 patented to J. F. Oullette on May 16, 2000 and assigned to Oullette Machinery Systems, Inc. on an "Infeed Assembly For Use With An Air Conveyor System"; and U.S. Pat. No. 6,089,951 patented Jul. 18, 2000 to E. Ostendorff and assigned to Mattel, Inc. on a "Toy Vehicle And Trackset Having Lap-Counting Feature".

SUMMARY OF THE INVENTION

The present invention provides a propulsion track apparatus including an object designed for movement therealong. This construction of this object preferably includes a first frame and a second frame maintained spatially disposed therefrom and flexibly resiliently movable with respect thereto by an interconnecting frame suspension such as a spring or other flexibly resilient member. This spring will maintain the first and second frames flexible with respect to one another and also slightly spatially disposed from one another to aid in such flexibility. Each of the frame means includes a wheel means rotatably mounted thereon to facilitate guiding of movement thereof through the pneumatic track and through the air tunnel. Preferably the first frame will include four such individual wheels and the second frame will include four additional such wheels to aid in this movement.

The pneumatic track of this apparatus extends generally longitudinally between a starting end and a terminating end in such a manner as to provide a path for movement of the object therealong. The pneumatic track includes an enclosed pneumatic conduit as the preferred construction thereof. The pneumatic track also includes a track air relief device which is positioned therein which is designed to allow excess air flow pressure within the track to be expelled. The track air relief means preferably will include a plurality of longitudinal slots defined therein extending longitudinally approximately parallel to the pneumatic track at a position adjacent to the starting end thereof. Preferably seven or some other odd number of longitudinal slots will be included in order to prevent interaction or engagement thereof with respect to the even number of wheels in the object to prevent interaction between the object and the longitudinal slots themselves.

The pneumatic track itself will preferably also include two individual track sections connected in parallel with respect to one another defined preferably as a primary track and a secondary track. At least one wide section will be positioned immediately upstream of the terminating end of the pneumatic track to urge movement of the object means to the track inlet irrespective of whether the object is moving within the primary section or the secondary section thereof.

A uniquely configured air control device is also preferably included in the present invention which is designed to be connected to the pneumatic track for the purpose of providing a continuous supply of pressurized air thereto in a controlled manner in order to continuously and effectively urge movement of the object therealong.

The air control device preferably includes an air control housing which defines a track inlet defined therein which is connected with respect to the terminating end of the pneumatic track to be in fluid flow communication therewith. In a similar manner a track outlet is defined by the air control housing spatially disposed from the track inlet and connected with respect to the starting end of the pneumatic track to be in fluid flow communication therewith. This air control device can be connected to more than one set of pneumatic tracks for the purpose of driving more than one object therethrough for providing the capability of side-by-side competitive racing using a single air control system. The system could include separate speed controls to aid in providing a competitive racing device.

An air tunnel is defined within the air control device which extends from the track inlet to the track outlet for maintaining fluid flow communication therebetween within the air control housing. In this manner the housing through the air tunnel will allow the object to move from the track inlet to the track outlet and then throughout the pneumatic track itself.

The air tunnel can preferably include an air recycling orifice therein to facilitate movement of the air into an air recycling chamber if necessary. The air tunnel preferably will include an inwardly tapered surface area immediately upstream from the air recycling orifice to urge an object passing therethrough to move toward the center of the air tunnel as it passes by the air recycling orifice in order to minimize contact and interaction therebetween.

The air control housing preferably further defines an entrance opening therein which facilitates the introduction of the object into the pneumatic track by movement thereof into the air tunnel. An entrance conduit is also included extending from the entrance opening to the air tunnel to facilitate movement of the object into the air tunnel and then into the pneumatic track.

A blower chamber is also defined within the air control means which defines a blower inlet and a blower outlet therein. A blower means is included to be positioned within the blower chamber which is adapted to draw air into the blower chamber through the blower inlet and to expel air flow under pressure therefrom outwardly through the blower outlets. One such blower outlet can supply air to a first set of pneumatic tracks and a second pneumatic track set can be attached to the other blower outlet to receive pressurized air therefrom for competitive racing side-by-side. The use of a single blower will aid in equalizing such a competitive usage.

An air pressure chamber is in fluid flow communication with respect to these blower outlets in order to facilitate the receiving of air flow under pressure therefrom. The air pressure chamber is positioned extending around the air tunnel means to provide pressurized air in the area immediately surrounding the air tunnel to aid in the flow of pressurized air thereinto. The flow of pressurized air into the air tunnel is achieved by the positioning of a directional flow tapered air inlet in the air tunnel within the air pressure chamber.

The directional flow tapered air inlet will be inclined from the track inlet toward the track outlet to facilitate introducing of pressurized air therethrough into the air tunnel to aid in propelling of objects therethrough in the direction from the track inlet toward the track outlet and urging movement of the object along the pneumatic track from the starting end thereof to the terminating end.

The directional flow tapered air inlet preferably includes a first angled tapered edge which is circular in shape and is defined in the air tunnel. It also preferably includes a second angular tapered edge which is circular in shape and is defined in the air tunnel spatially disposed from the first angular tapered section in order to define an annulus means therebetween which is inclined in the direction of movement of the object therethrough from the track inlet toward the track outlet. In this manner propulsion thereof will be facilitated along the air tunnel. The second angular tapered edge is movable relative to the first angular tapered edge in such a manner adjustably in order to vary the size of the annulus defined therebetween to vary the magnitude of air flow under pressure therethrough. Furthermore the annulus can be adjustably positioned to be completely closed under some circumstances for example in order to facilitate the supply or more air for a certain temporary period of time to be supplied through another flower outlet for powering of a different section of the pneumatic track or for powering a separate pneumatic track.

An outer sleeve may preferably be included which is movably mounted with respect to the air tunnel with the second angular tapered edge defined thereon such that the size of the annulus is variable responsive to relative movement of the outer sleeve with respect to the air tunnel to control the magnitude of air flow therethrough. This outer sleeve can be movable with respect to the air tunnel by being threadably engaged in the air control housing or by being tightly fitted to the outside diameter of the air tunnel and movable under force at various positions therealong.

A pressure release valve may be included extending from the air pressure chamber to the external ambient environment in order to facilitate the exhausting of air under pressure beyond the predetermined value to prevent excessive air pressure build up within the air pressure chamber. The pressure release valve also may include a one-way valve responsive to allow air only to exit from the air pressure chamber. Additionally, the pressure release valve can be adjustable to vary the level of air pressure that it is able to exhaust in order to in this manner provide a means for reducing or increasing the air under pressure within the track. In this manner the pressure release valve will operate similar to a throttle and can truly be used as a throttle by the individual making use of the pneumatic track apparatus of the present invention. Thus adjustment of the throttling of the pressure release valve can control the actual speed of movement of the object through the track.

An air recycling device may be included having an air recycling chamber defined within the air control body in fluid flow communication with respect to the air recycling orifice in the air tunnel to receive air flow pressure therefrom. The air recycling device may also include an air recycling conduit extending from the air recycling chamber to the blower inlet to allow air flow under pressure from the air recycling orifice flowing into the air recycling chamber to move on through the air recycling conduit to the blower inlet for recycling.

An adjustable suction cap may also be included positioned extending over the blower inlet to control the amount of air flow thereinto to further control the amount of air under pressure entering the air pressure chamber responsive to various different configuration of the pneumatic track. The adjustable suction cap is variable in order to increase or decrease the amount of atmospheric air drawn into the blower. The suction cap is operable when moved to a more closed position to create an input vacuum adjacent the input into the blower. Since the air recycling conduit flows into a location between the blower and the suction cap this vacuum will be experienced therein. This vacuum will tend to draw or suck air toward the blower from the air recycling chamber which is drawn from the air tunnel extending therethrough by being drawn therefrom through the air recycling orifice means. The movement of air in this manner exiting the air tunnel is very effective in eliminate deadspots. These dead spots are areas within the air tunnel or in the air track adjacent the air tunnel where the object can hesitate or stop due to inadequate air flow therethrough. Thus by careful adjustment in positioning of the suction cap these dead zones can be eliminated or at least minimized.

One or more removable caps may be included positioned detachably extending across the entrance opening for selectively sealing thereof to prevent the flow of air inwardly therethrough after the introduction of an object therethrough into the air tunnel. The removable cap may be responsive to excess air flow pressure within the air pressure chamber to allow air flow leakage outwardly there passed from the air pressure chamber and to relieve excessive back pressure.

A switching device may also be usable with the present invention which is attached with respect to the track outlet of the air control body and is attached with respect to the starting end of the pneumatic track. This switching means is movable between at least one or more recirculating positioned to allow the object to recirculate through the pneumatic track through a primary or secondary section thereof or through a second pneumatic track and an exit position which allows the object to exit for removal thereof from all pneumatic tracks. The switching device may include two or more such recirculating positions as needed based upon the configuration of the particular track.

It is an object of the present invention to provide a pneumatic propulsion track apparatus which is easy to maintain.

It is an object of the present invention to provide a pneumatic propulsion track apparatus which has a minimum amount of moving parts to minimize maintenance requirements.

It is an object of the present invention to provide a pneumatic propulsion track apparatus which is capable of projecting an object through very sharply curved portions of the track due to the flexibly resilient frame construction and multiple wheels included in the object.

It is an object of the present invention to provide a pneumatic propulsion track apparatus which does not include any small parts and, as such, can be easily and safely operated by young persons.

It is an object of the present invention to provide a pneumatic propulsion track apparatus which can be utilized as an advertising or promotion vehicle for commercial purposes.

It is an object of the present invention to provide a pneumatic propulsion track apparatus which can be formed with transparent track members to facilitate viewing of the object as it travels through the path.

It is an object of the present invention to provide a pneumatic propulsion track apparatus which eliminates all problems associated with back pressure and in this manner provides a steady force to the object to maintain its continuous rapid movement through the pneumatic track and the air tunnel.

It is an object of the present invention to provide a pneumatic propulsion track apparatus which can be configured to include two separate and distinct pneumatic tracks both of which can be supplied with air from one blower means having a divider which separates the outgoing air into two streams passing through two separate track outlets to facilitate competitive side-by-side racing as a utility of the present invention.

It is an object of the present invention to provide a pneumatic propulsion track apparatus wherein the pressure release valve can include a throttle means to provide instantaneous control of the purposeful release of pressurized air therethrough in order to function as a throttle for competitive racing modes of operation and other modes where use of such a throttle adds to the level or enjoyment or utility of the present invention.

It is an object of the present invention to provide a pneumatic propulsion track apparatus which can be utilized for advertising or promotional purposes or other commercial purposes as an attention grabber or for more utilitarian purposes such as use as a means of conveyance.

BRIEF DESCRIPTION OF THE DRAWINGS

While the invention is particularly pointed out and distinctly claimed in the concluding portions herein, a preferred embodiment is set forth in the following detailed description which may be best understood when read in connection with accompanying drawings, in which:

DETAILED DESCRIPTION OF THE PREFERRED EMBODIMENT

Figure 1:
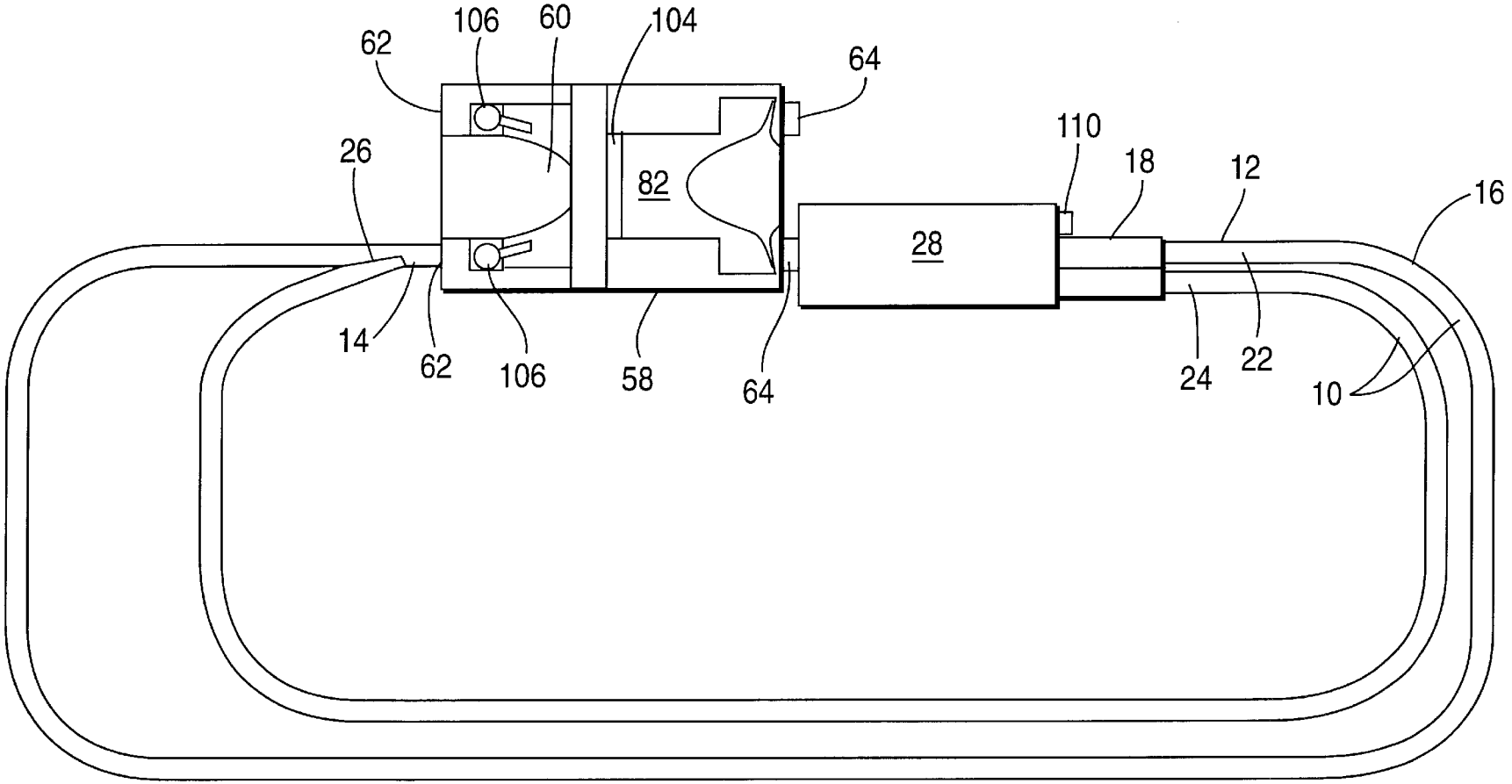
FIG. 1 is a schematic illustration of the pneumatic track of the pneumatic propulsion track apparatus of the present invention.
Figure 2:
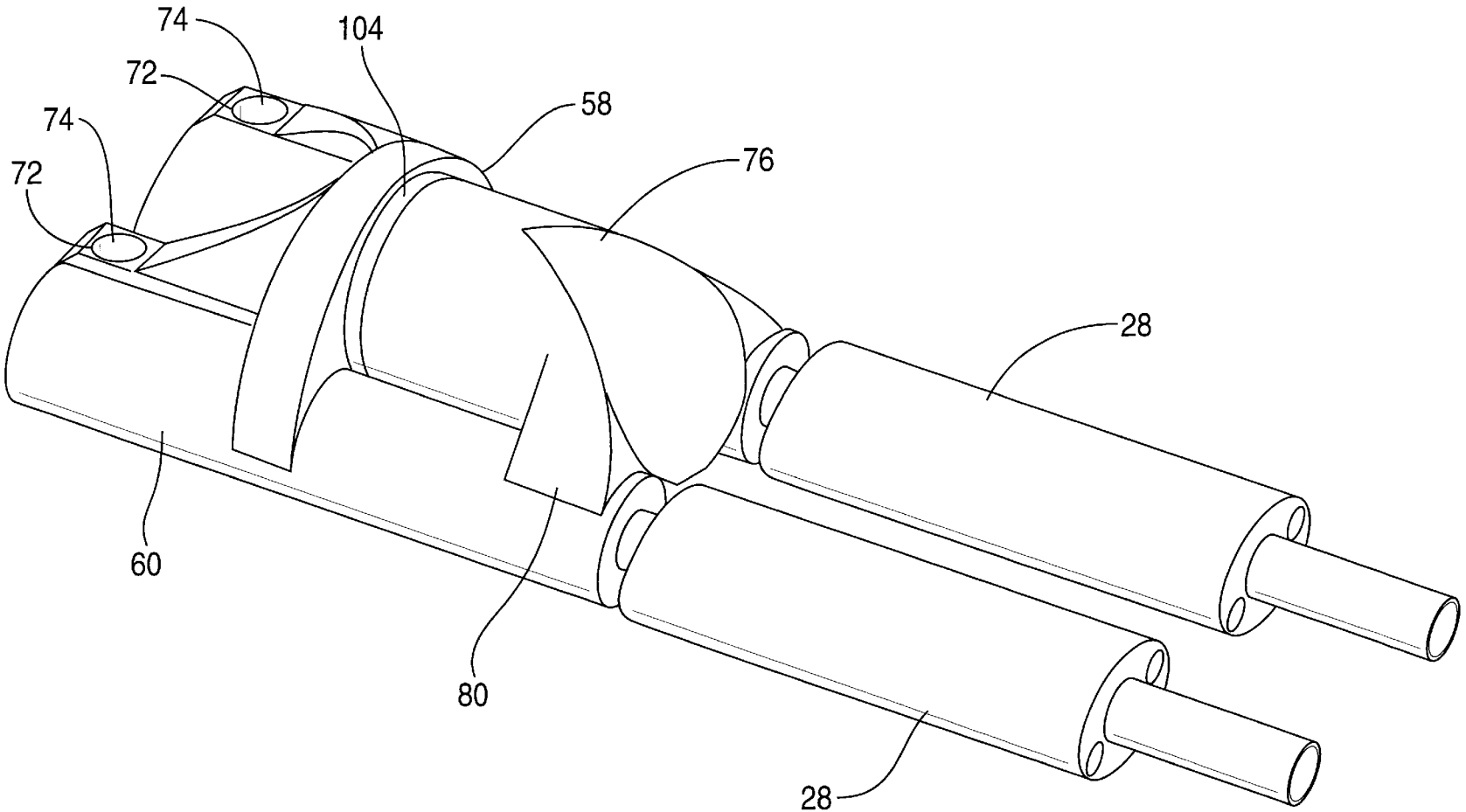
FIG. 2 is a perspective illustration of the air control means and switch means of an embodiment of the present invention.

The present invention provides a pneumatic track 10 designed to receive an object means 34 for traveling therethrough and recirculating therewithin. The pneumatic track 10 preferably includes a starting end 12 and a terminating end 14 wherein the object 34 moves from starting end 12 toward terminating end 14.

The configuration of the pneumatic track 10 preferably is as an enclosed pneumatic conduit 16 which preferably is made of clear material to facilitate viewing of the object as it travels therealong. The pneumatic track 10 preferably will include a track air relief means 18 somewhat close to the starting end 12 thereof to facilitate the release of excessive air flow pressure within the track. This air relief 18 is provided preferably through a plurality of longitudinal slots 20 defined in the tubular track air relief member 18. Preferably such longitudinal slots 20 are seven in number but can be any number as desired.

The pneumatic track 10 preferably includes a primary track section 22 and a secondary track section 24. A switching means 28 is positioned immediately adjacent to the starting end 12 of the pneumatic track 10 and is movable between one or more individual recirculating positions to urge movement of the object after it passes through the switch 28 to move to one or more of the individual sections of pneumatic track 10. Additionally the switch 28 will preferably include an exit position 32 to which it can be moved in order to allow removal of the object 34 from the pneumatic track 10 entirely.

A y-section 26 can be included adjacent to the terminating end 14 of the pneumatic track 10 for the purpose of gathering an object traveling in either section of the pneumatic track 10 to move to the terminating end 14 and on into the air control means 58. One y-section is needed for a pneumatic track 10 which includes two individual sections and an additional y-section is needed for each additional section included thereafter.

The object 34 preferably is of a specific construction in order to facilitate movement thereof in a continuous manner subject to air pressure thereagainst through the pneumatic track 10. The object 34 preferably includes a first frame 36 and a second frame 38. A frame suspension means 40 is included preferably being flexibly resilient and most preferably being a flexibly resilient spring which will maintain the first frame and the second frame 36 and 38 somewhat spaced apart and flexibly resiliently movable with respect to one another. The first frame 36 will include a first frame wheel means 42 adapted to engage the interior of the enclosed pneumatic conduit 16. Similarly the second frame 38 will include second frame wheels 44 also adapted to engage the interior of the enclosed pneumatic conduit 16 of the pneumatic track 10. First frame wheels 42 will preferably include four individual first frame wheels 46. In a similar manner second frame wheel means 44 will include four individual second frame wheels 48. The number of wheels can vary however the preferred configuration is to have eight total wheels for the object 34. The first frame wheels 46 are mounted upon first axle means 50 on the first frame 36. The second frame wheels 48 are mounted on the second axle means 52 of the second frame 38.

In operation the movement of the object 34 throughout the track is enhanced due to the flexibly resiliently mounted relationship between the first frame wheels 46 and the second frame wheels 48. This flexibility will allow the object to distort slightly as it travels through curved portions of the enclosed pneumatic conduit 16 in order to prevent binding and more freely and easily move therealong. The air control means 58 of the present invention includes an air control housing 60. Housing 60 will define a track inlet 62 for receiving the terminating end 14 of pneumatic track 10. Track outlet 64 will define a point of attachment for the switching means 28 or the track air relief device 18. However it will be attached indirectly or directly with respect to the starting end 12 of pneumatic track 10. An air tunnel 66 extends from track inlet 62 to track outlet 64 for maintaining fluid flow communication and providing a path therebetween for movement of the object 34 therethrough.

An entrance opening 72 is defined in the air control housing 60 which is adapted to receive the object 34 placed therein for movement toward the air tunnel 66 and on into the pneumatic track 10. An entrance conduit 74 extends from the entrance opening 72 to the air tunnel 66 to allow object 34 to move thereinto.

A blower chamber 76 is defined within the air control housing 60 and defines a blower inlet 78 for receiving air therethrough and a blower outlet 80 for expelling air outwardly therefrom. A blower or other motor device 82 is positioned within the blower chamber 76 and is adapted to draw air inwardly through the blower inlet 78 and expel air outwardly through the blower outlet 80.

Blower outlet 80 is connected to an air pressure chamber 84 defined within the air control housing 60. Air pressure chamber 84 is defined to receive air flow under pressure from the blower outlet by operation of the blower 82 such that the air within the air pressure chamber 84 will flow therein and be pressurized therewithin.

The air pressure chamber preferably will be positioned extending adjacent to or, preferably in this configuration, surrounding the air tunnel 66 at the point where the air tunnel defines a directional flow tapered air inlet 86. This directional flow air inlet 86 will be adapted to receive pressurized air flow therethrough from the air pressure chamber 84 for supplying of pressured air into the air tunnel 66 for urging movement of the object 34 through the air tunnel 66 and thereafter through the pneumatic track 10.

The directional flow tapered air inlet means 86 is defined as the annulus 92 positioned between the first angular tapered edge 88 and the second angular tapered edge 90. This design is most clearly shown in FIGS. 5 and 9. It is also preferable that the size of this annulus 92 be variable in order to vary the amount of air introduced into the air tunnel 66 for powering of various different configurations and sizes of the pneumatic track 10. The size of the annulus 92 can be changed to zero wherein no air flow therethrough is possible. This adjustable position would usually be for the purpose of supplying greater quantities of air to another pneumatic track section or to another pneumatic track being used currently.

Figure 5:
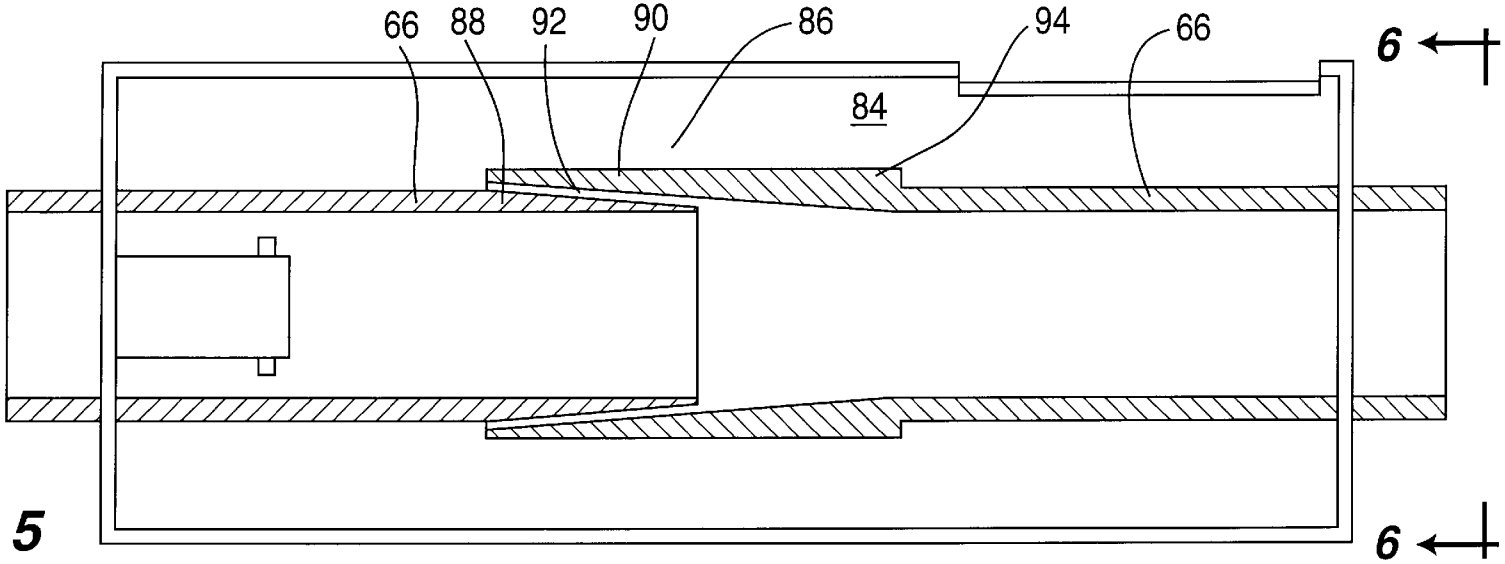
FIG. 5 is a side plan view of an embodiment of the air pressure chamber.
Figure 6:
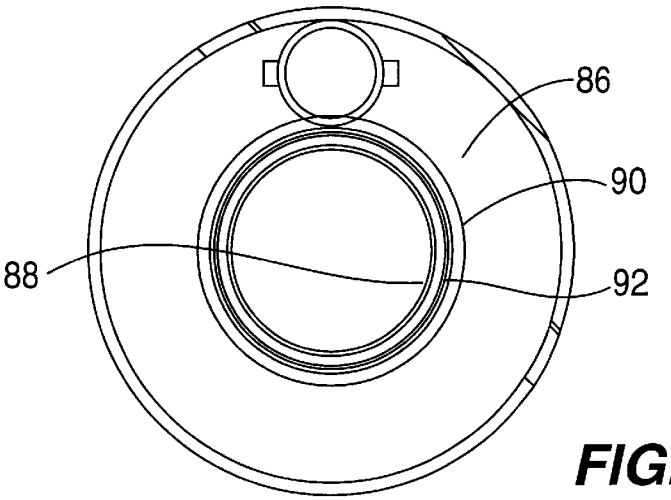
FIG. 6 is an end plan view of FIG. 5.

For this purpose the size of the annulus 92 can be adjustable by various means. One such means would be the movement of the second angular tapered edge 90 relative to the first angular tapered edge 88 thereby increasing or decreasing as necessary the size of the annulus 92 and therefore the air flow under pressure therethrough. This preferred configuration is shown in FIG. 5 by the inclusion of an outer sleeve member 94 which is movable longitudinally with respect to the air tunnel 66. Since the outer sleeve 94 defines the second angular tapered edge 90 thereon, movement of this outer sleeve means 94 relative to the air tunnel 66 will cause a change in the total cross-sectional air flow area of the annulus 92. This outer sleeve means 94 can be movable relative to the air tunnel 66 by being threadably engaged to the external surface of the air tunnel or can be merely a tight fit on the outside diameter of the air tunnel 66 in such a manner as to be forcibly slidable therealong.

The present invention also includes a pressure release valve 96 which is defined to release any excess pressure created within the pneumatic track 10 and within the air tunnel 66 as necessary. This is a one-way valve allowing flow only outwardly from the interior portion of the pneumatic track 10 and air tunnel 66 to the external ambient environment.

An air recycling means 98 may also be included and has an air recycling chamber 100 defined adjacent the air tunnel 66 at a point within the air control housing 60 upstream from the air pressure chamber 84. This air recycling chamber 100 will be positioned adjacent to the air tunnel 66 at a position where the air recycling orifice means 68 is defined in the air tunnel 66. This orifice is adapted to allow excessive air pressure within the air tunnel 66 immediately adjacent the air recycling chamber 100 to be expelled therethrough and thereafter move through the air recycling conduit 102 to be supplied through the blower inlet 78 for recycling of the air to the blower 82. This air movement will help eliminate dead zones caused by back pressure and will facilitate continuous movement of the object as it passes through the air tunnel at the position therein where the directional flow tapered air inlet 86 is located. Furthermore this amount of vacuum created within the air recycling conduit 102 can be varied by selective positioning of the adjustable suction cap 104. Positioning cap 104 such that increased suction or vacuum is created adjacent the input of blower 82 will cause suction to extend through air recycling conduit 102 thus drawing air under pressure through air recycling orifice 68 from within air tunnel 66 thereby further reducing the possibility of experiencing any deadzones as object 34 moves therethrough.

Figure 7:
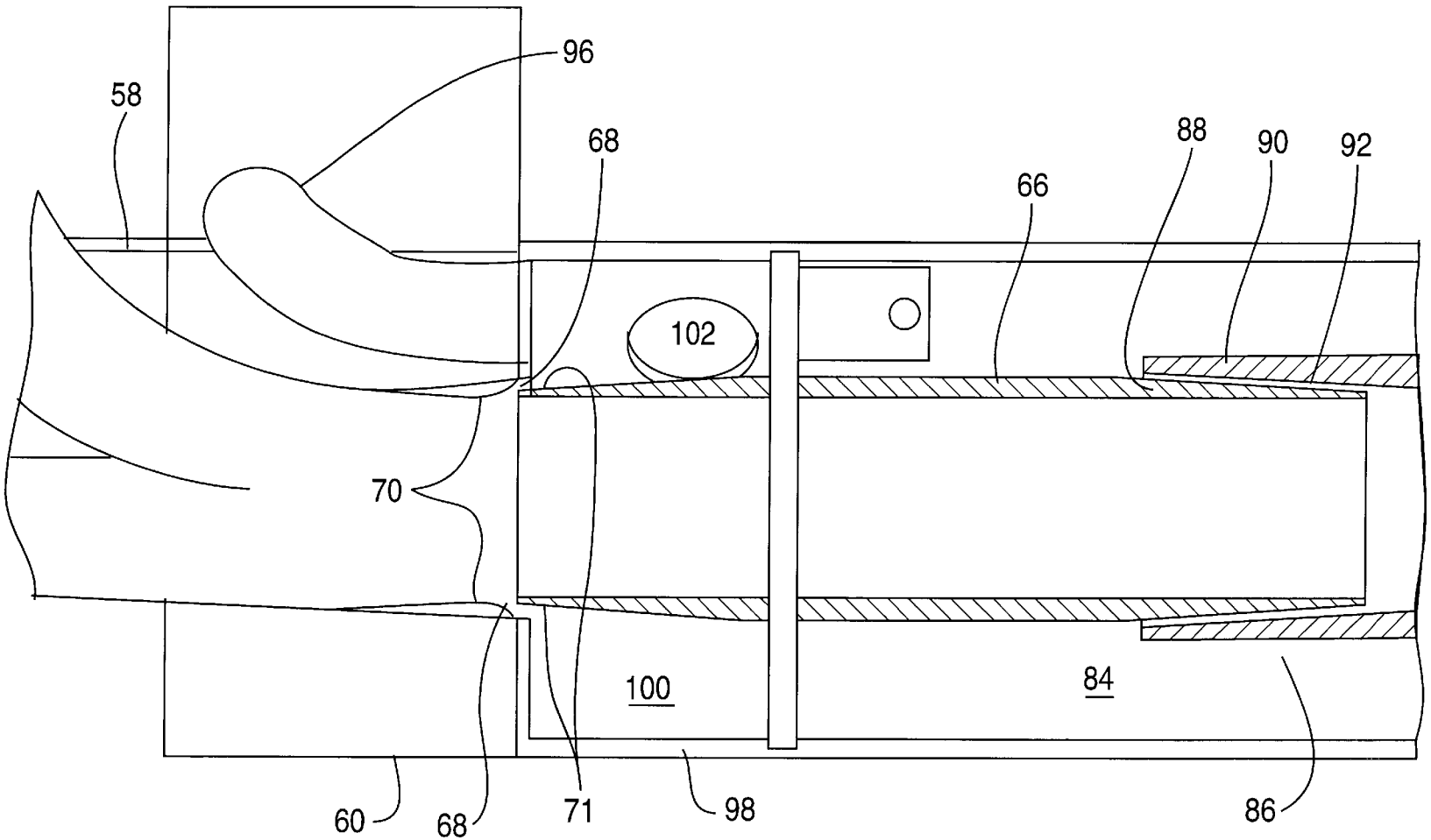
FIG. 7 is a side cross-sectional view of a portion of the air control housing of the present invention illustrating in detail the configuration of the air recycling orifice and the inwardly tapered surface area within the air recycling chamber.
Figure 8:
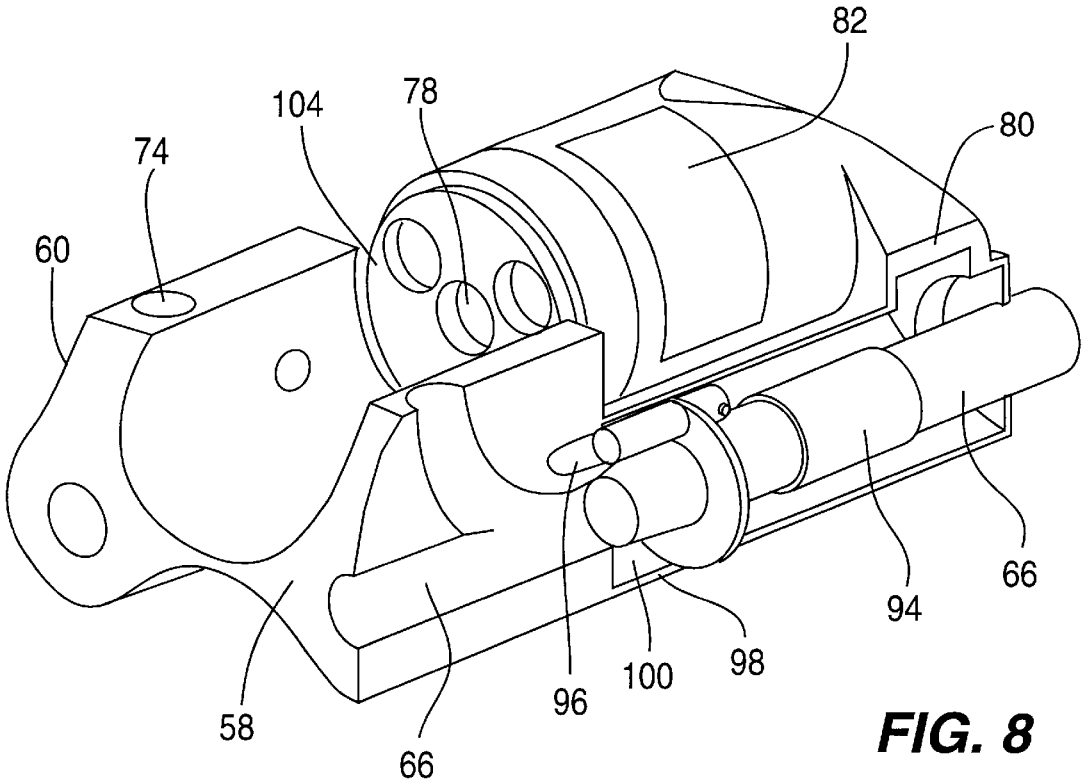
FIG. 8 is a perspective illustration of the air control means clearly showing the adjustable suction cap means.

As the object 34 passes by the air recycling orifice 68 it is important that interaction between the object and particularly the wheels of the object and the air recycling orifice 68 be minimized. To achieve this inwardly tapered surface areas 70 are positioned within the air tunnel 66 immediately upstream from the air recycling orifice 68 to move the object 34 to the centralmost portion of the air tunnel 66 as it passes by the air recycling orifice 68. The male end of the air tunnel 66 also has tapered areas 71 as shown in FIG. 7, which are spatially disposed from the inwardly tapered surface areas 70 to define an narrow open area in the air tunnel 66. In this manner contact or engagement between the air recycling orifice 68 and the object 34 will be minimized and most likely eliminated.

The present invention may include an adjustable suction cap 104 means positioned extending over the blower inlet 78 of blower chamber 76. This adjustable suction cap 104 is operative to move or rotate in some manner as to control the total volume of air made available through the blower inlet 78 to the blower 82 for movement thereof into the air pressure chamber 84. This adjustable suction cap 104 will preferably have various positions pre-set as necessary for different track configurations and/or sizes and/or shapes. These setting will each provide a different vacuum or suction applied through the air recycling conduit 102 which will draw different volumes and flows of air therefrom from the air tunnel 66 through air recycling orifice 68. Thus the positioning of the suction cap means 104 can be prechosen for various configurations of possible shapes of the track 10 of the present invention such that deadzones are minimized under each of the many different possible track configurations.

Removable cap members 106 may be included in the present invention positioned over the entrance opening 72 to eliminate movement of air therethrough into the air tunnel 66 except during those times when an object 34 is being introduced therethrough. Preferably the removable caps 106 will also be responsive to pressurized air flow through the entrance conduit 74 to slightly dislodge to from the entrance opening 72 and release pressure externally therefrom. This will be an important supplemental source of pressured relief.

The objects 34 used with the present invention may preferably include decorative bodies such as 108 on the exterior surface thereof to facilitate aesthetic enjoyment of the pneumatic propulsion track apparatus of the present invention. Also, the switching device 28 of the present invention preferably will include an exit hole 110 to allow the objects 34 to be expelled from the pneumatic propulsion track apparatus.

Figure 3:
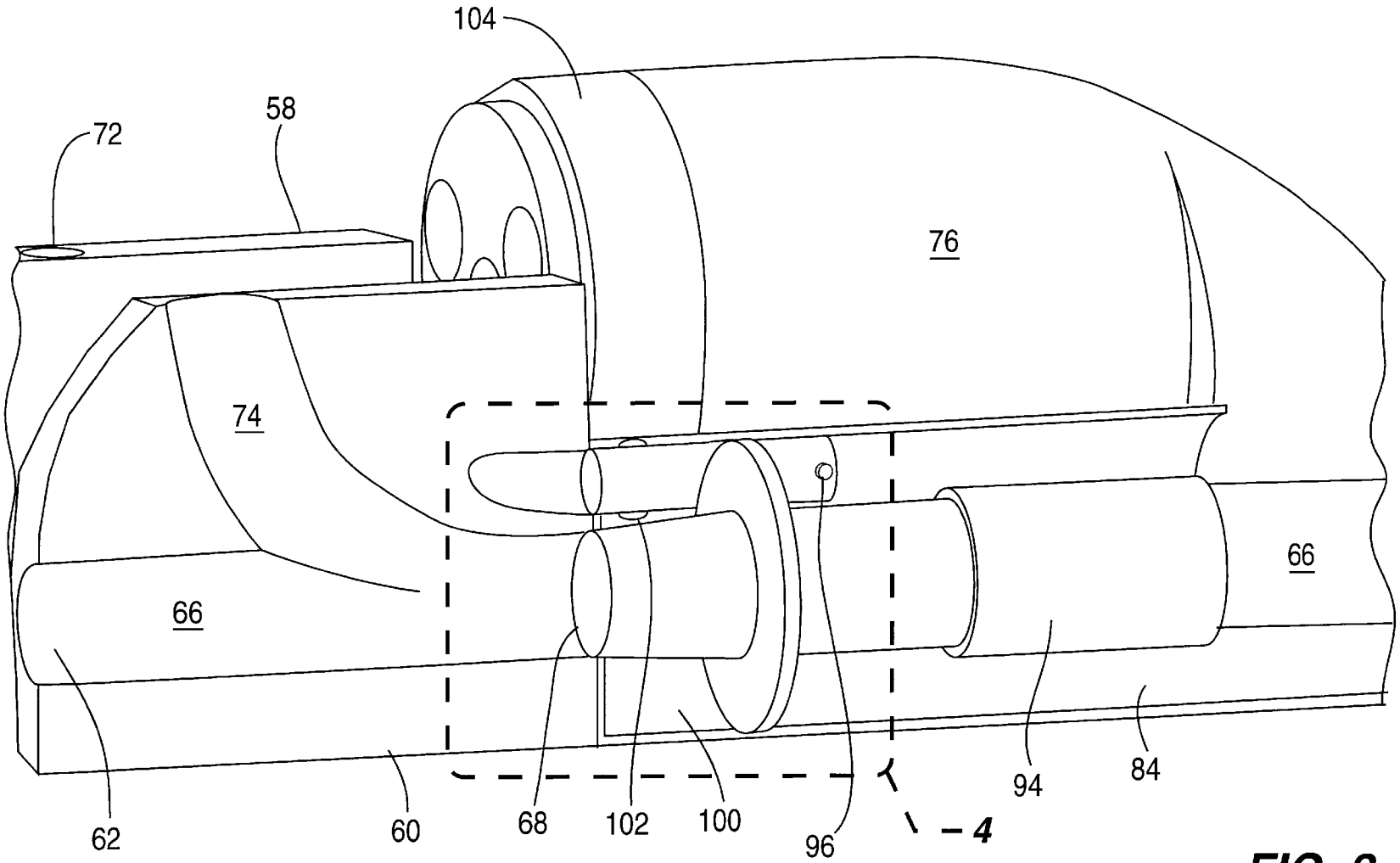
FIG. 3 a side view of an embodiment of the air control body of the present invention showing in broken view the air recycling chamber and the air pressure chamber.
Figure 4:
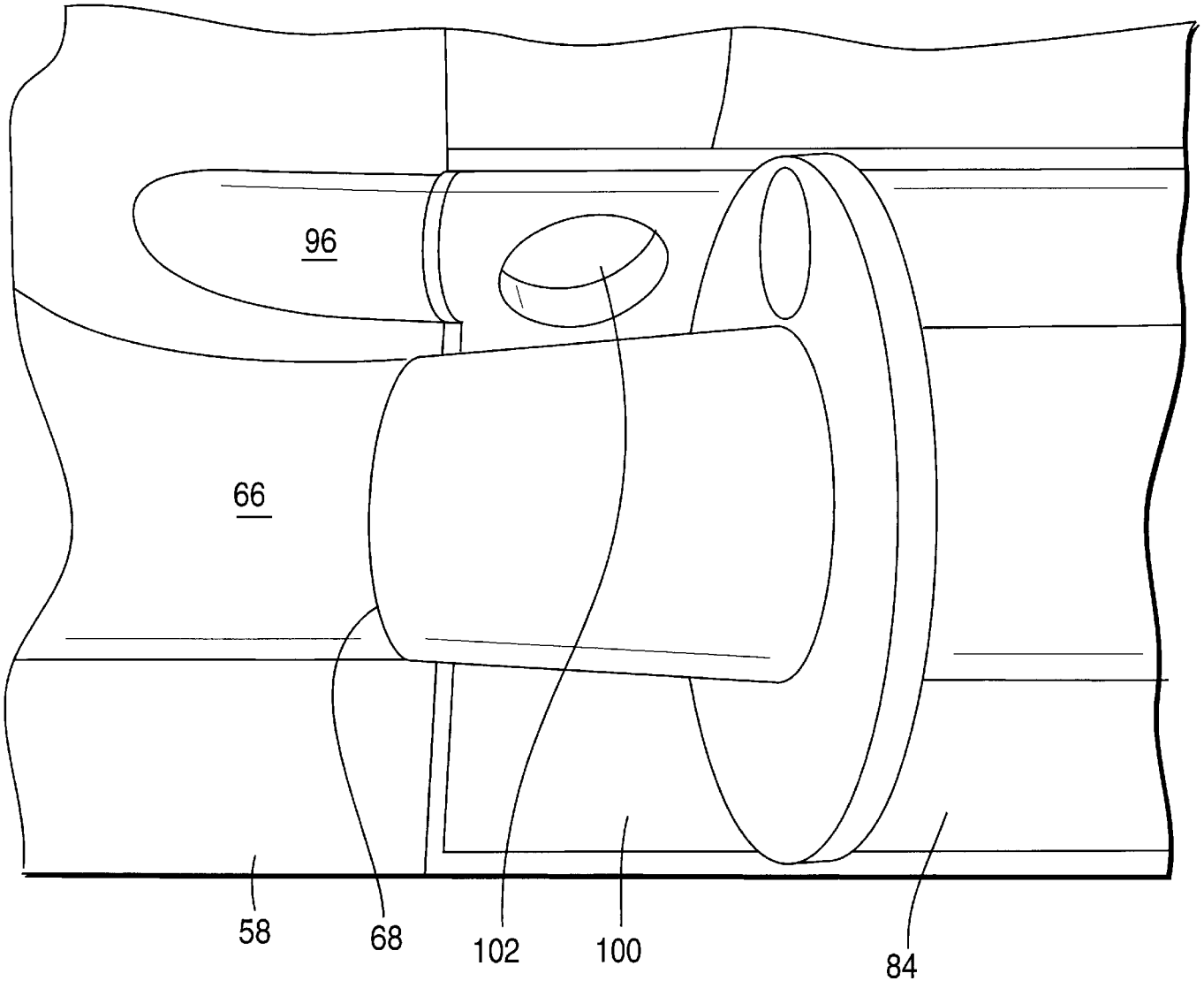
FIG. 4 is a showing of FIG. 3 along lines 4—4 to show the air recycling chamber and conduit more clearly.
Figure 9:
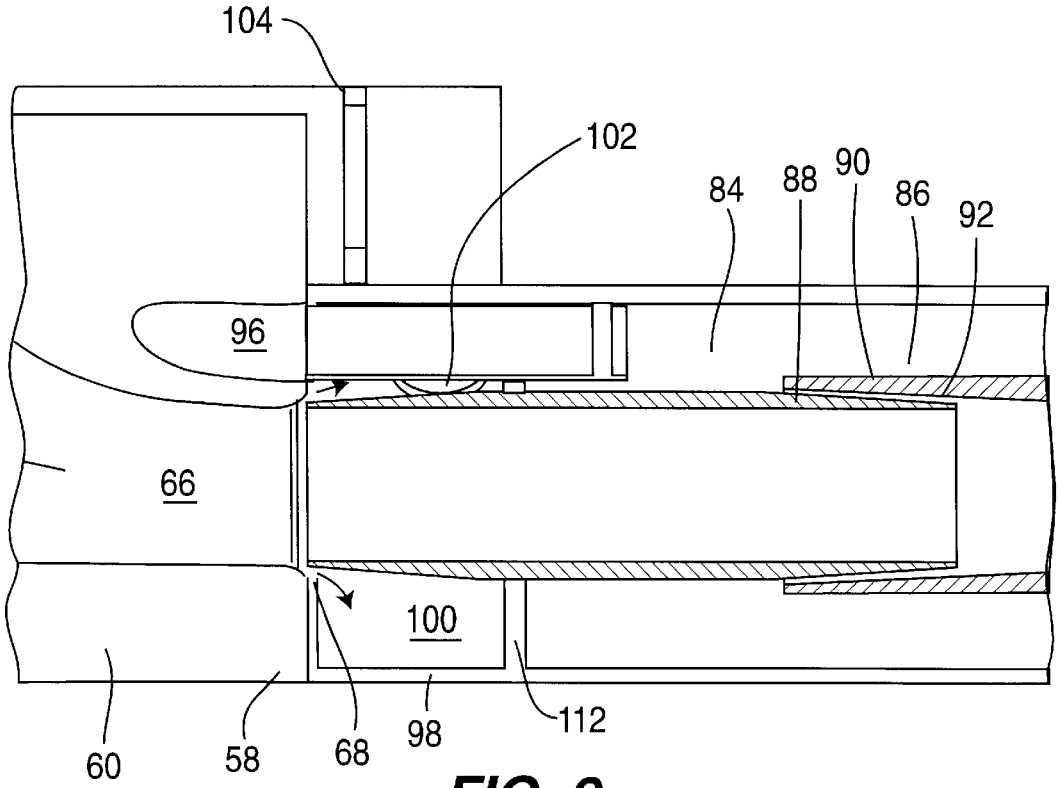
FIG. 9 is a side cross-sectional view of a portion of the air control means showing the pressure release valve and the divider wall separating the air recycling chamber from the air pressure chamber.
Figure 10:
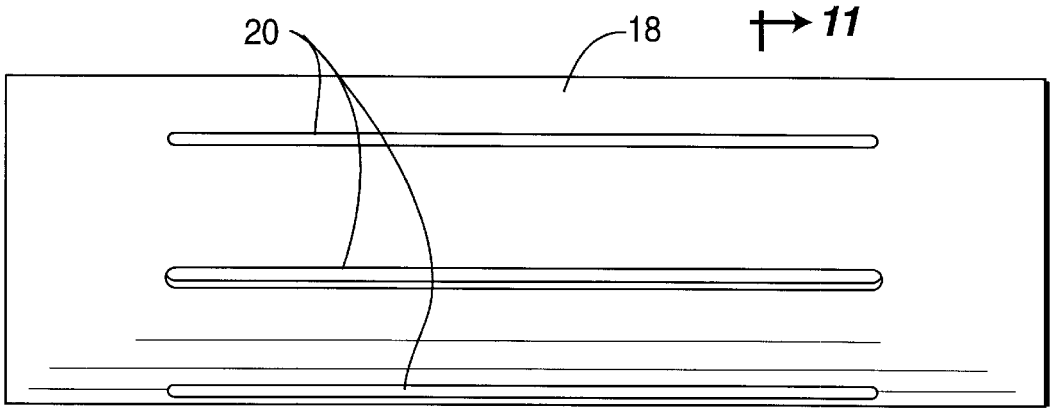
FIG. 10 is a side plan view of the track air relief device of the present invention showing the longitudinal slots therein.
Figure 11:
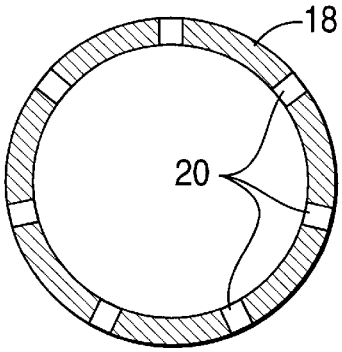
FIG. 11 a cross-sectional view of FIG. 10 along lines 11—11.
Figure 12:
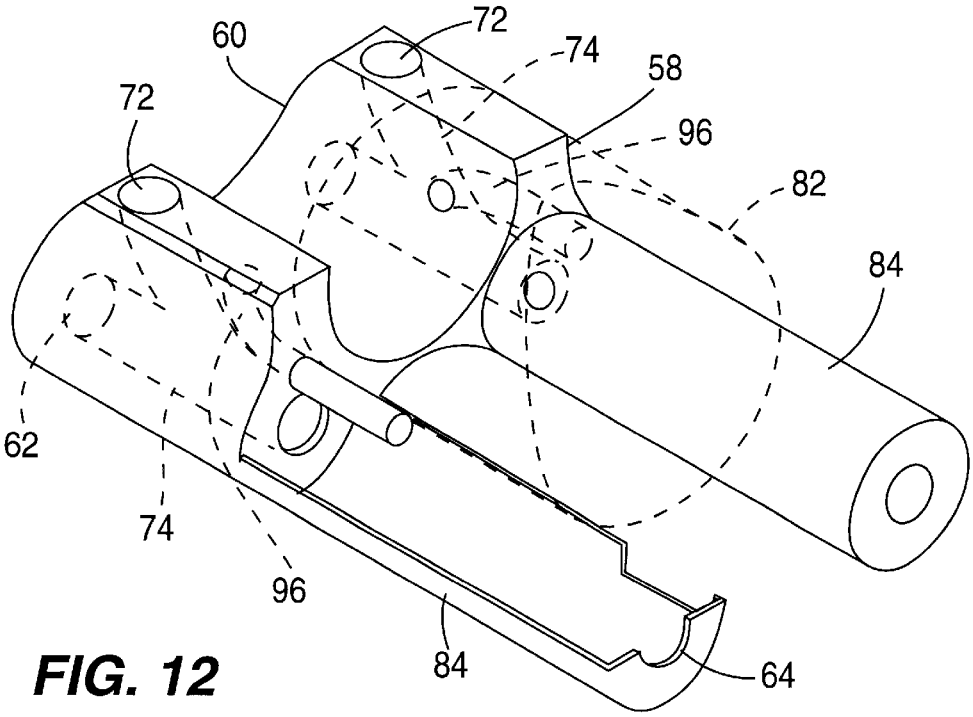
FIG. 12 is a perspective schematic illustration of an embodiment of the air control means of the present invention.
Figure 13:
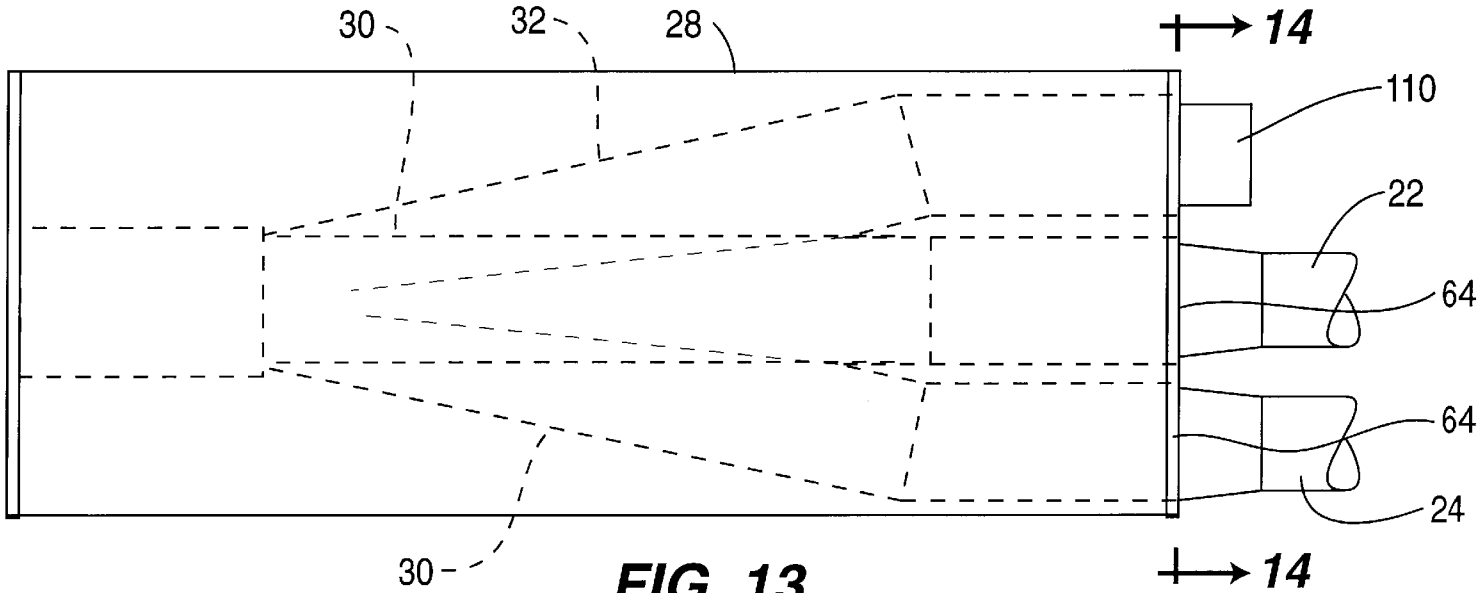
FIG. 13 a top cross-sectional view of an embodiment of the switching device of the present invention.
Figure 14:
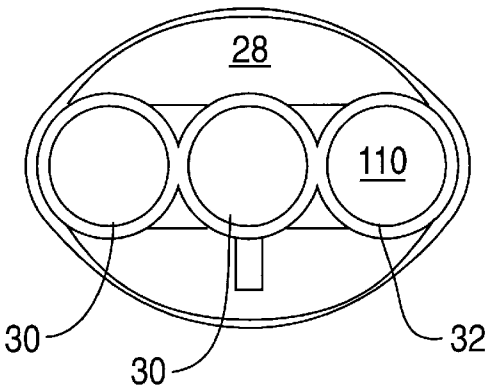
FIG. 14 is a side view of FIG. 13 along lines 14—14.
Figure 15:
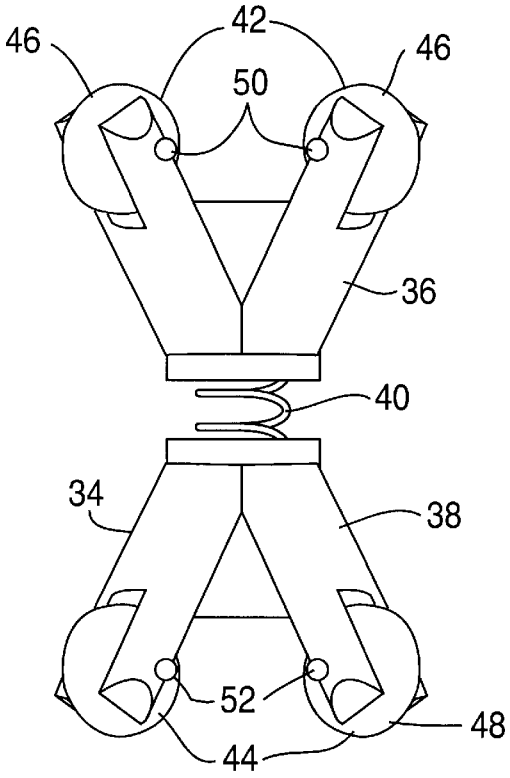
FIG. 15 is a front plan view of an embodiment of an object of the present invention showing the dual frame construction spaced apart and flexibly movable with respect to one another by a flexibly resilient interconnecting frame suspension.
Figure 16:
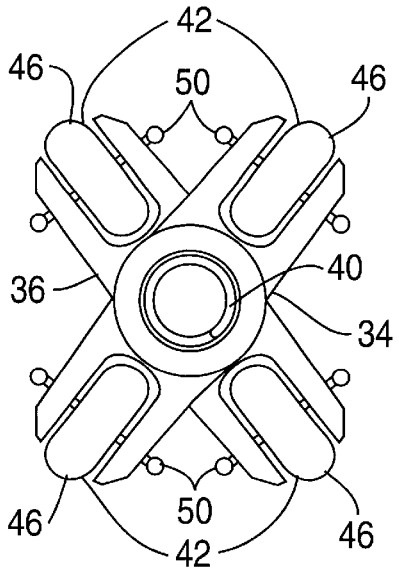
FIG. 16 is a top view of the object device shown in FIG. 15.
Figure 17:
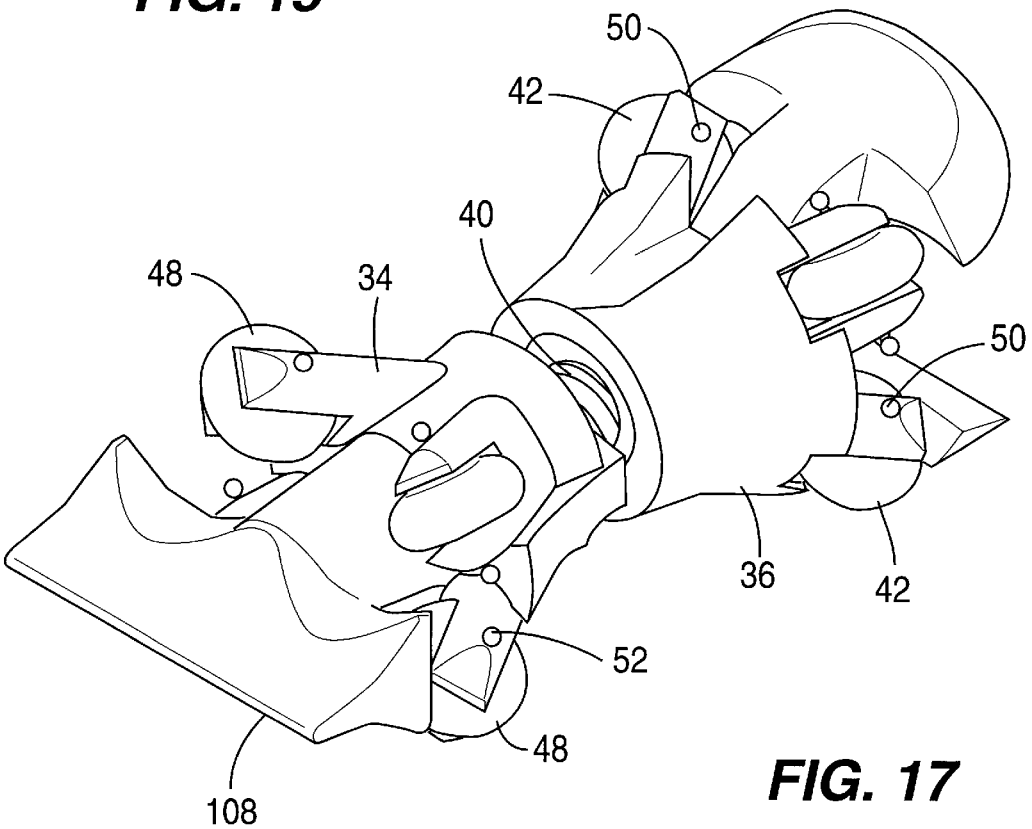
FIG. 17 is a perspective illustration of a embodiment of a decorative body usable on a object.

In a preferred configuration as shown best in FIGS. 3, 7 and 9 the air recycling chamber means 100 will extend around the air tunnel means 66 and the air pressure chamber area 84 will also extend around the air tunnel 66. Preferably, as shown in these drawings, the air pressure chamber 84 will be immediately downstream from the air recycling chamber 100. These chambers can be similar in shape and are preferably separated by a divider wall 112.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A pneumatic propulsion track apparatus comprising:

A. an object means for movement along the propulsion track apparatus;

B. a pneumatic track means extending longitudinally from a starting end means to a terminating end means and providing a path for movement of said object means therealong;

C. an air control means connected to said pneumatic track means for supplying of pressurized air thereinto in a controlled manner to urge movement of said object means therealong, said air control means comprising:

(1) an air control housing means;

(2) a track inlet means defined in said air control housing means and connected with respect to said terminating end means of said pneumatic track means to be in fluid flow communication therewith;

(3) a track outlet means defined in said air control housing means spatially disposed from said track inlet means and connected with respect to said starting end of said pneumatic track means to be in fluid flow communication therewith;

(4) an air tunnel means extending from said track inlet means to said track outlet means for maintaining fluid flow communication therebetween within said air control housing means to allow said object means to move from said track inlet means to said track outlet means and through said pneumatic track means;

(5) an entrance opening means defined in said air control housing means to facilitate introduction of said object means into said air tunnel means and into said pneumatic track means;

(6) an entrance conduit means extending from said entrance opening means to said air tunnel means to facilitate movement of said object means into said air tunnel means and said pneumatic track means;

(7) a blower chamber means defined within said air control housing and defining a blower inlet means and a blower outlet means;

(8) a blower means positioned within said blower chamber means and adapted to draw air into said blower chamber means through said blower inlet means and to expel air outwardly therefrom through said blower outlet means;

(9) an air pressure chamber means in fluid flow communication with respect to said blower outlet means of said blower chamber means to facilitate receiving of air under pressure from said blower means thereinto, said air pressure chamber means being positioned extending around said air tunnel means; and

(10) a directional flow tapered air inlet means defined in said air tunnel means at a position within said air pressure chamber means, said directional flow tapered air inlet means being inclined from said track inlet means toward said track outlet means for introducing of pressurized air therethrough into said air tunnel means to facilitate propelling of said object means therethrough in a direction from said track inlet means toward said track outlet means and urging movement of said object means along said pneumatic track means from said starting end means of said pneumatic track means to said terminating end means thereof.

2. A pneumatic propulsion track apparatus as defined in claim 1 wherein said pneumatic track means comprises a pneumatic conduit which is enclosed.

3. A pneumatic propulsion track apparatus as defined in claim 1 wherein said directional flow tapered air inlet means is adjustable in size to vary the magnitude of air flow therethrough.

4. A pneumatic propulsion track apparatus as defined in claim 1 wherein said directional flow tapered air inlet means comprises:

A. a first angular tapered edge being circular in shape defined on said air tunnel means;

B. a second angular tapered edge being circular in shape and defined on said air tunnel means spatially disposed from said first angular tapered edge to define an annulus means therebetween inclined in the direction of movement of said object means therethrough from said track inlet means toward said track outlet means to facilitate propulsion thereof along said air tunnel means.

5. A pneumatic propulsion track apparatus as defined in claim 4 wherein said air tunnel means includes an outer sleeve means movably mounted with respect to said air tunnel means with said second angular tapered edge defined thereon and wherein the size of said annulus means is variable responsive to relative movement of said outer sleeve means with respect to said air tunnel means to control the magnitude of air flow therethrough.

6. A pneumatic propulsion track apparatus as defined in claim 1 wherein said air control housing further defines a pressure release valve means extending from said air pressure chamber means to the external ambient environment to facilitate exhausting of air pressure beyond a predetermined value to prevent excessive air pressure within said air pressure chamber means, said pressure release valve means comprising a one-way valve means responsive to only allow air to exit from said air pressure chamber means, said pressure release valve being adjustable to control the exhausting of air therefrom to provide a level of throttle control during movement of said object means through said pneumatic track means.

7. A pneumatic propulsion track apparatus as defined in claim 1 further comprising a switching means attached with respect to said track outlet means of said air control means and attached with respect to said starting end means of said pneumatic track means, said switching means movable between a recirculating position allowing said object means to recirculate through said pneumatic track means and an exiting position allowing said object means to exit from said pneumatic track means.

8. A pneumatic propulsion track apparatus as defined in claim 7 wherein pneumatic track means includes at least two individual track sections connected in parallel with respect to one another and wherein said switching means includes at least two recirculating positions to facilitate recirculating movement of said object means through more than one of said individual track sections of said pneumatic track means.

9. A pneumatic propulsion track apparatus as defined in claim 8 wherein said pneumatic track means further includes at least one y-section positioned downstream from said switching means and immediately upstream of said terminating end means of said pneumatic track means to urge movement of said object means to said track inlet means responsive to movement thereof through any of said individual track sections.

10. A pneumatic propulsion track apparatus as defined in claim 1 wherein said air control housing further includes an adjustable suction cap means extending over said blower inlet means to control the amount of air flow thereinto to control the amount of air under pressure entering said air pressure chamber means responsive to various different configurations of said pneumatic track means.

11. A pneumatic propulsion track apparatus as defined in claim 1 wherein said air control housing further includes a removable cap member detachably positionable over said entrance opening means for selectively sealing thereof to prevent flow of air inwardly therethrough after introduction of an object means therethrough into said air tunnel means, said removable cap member being responsive to excess air flow pressure within said air pressure chamber means to allow air flow leakage outwardly therepast from said air pressure chamber means and to relieve excess back pressure therepast.

12. A pneumatic propulsion track apparatus as defined in claim 1 wherein said pneumatic track means defines a track air relief means to allow excess air flow pressure within said pneumatic track means to be expelled therefrom.

13. A pneumatic propulsion track apparatus as defined in claim 12 wherein said track air relief means comprising a plurality of longitudinal slot means defined in said pneumatic track means extending longitudinally approximately parallel to said pneumatic track means at a position adjacent said starting end means thereof.

14. A pneumatic propulsion track apparatus as defined in claim 1 wherein said object means comprises:

A. a first frame means;

B. a second frame means spatially disposed from said first frame means;

C. a frame suspension means secured fixedly with respect to said first frame means and said second frame means for maintaining spatial separation therebetween, said frame suspension means being made of flexibly resilient material to facilitate flexibly resilient relative movement between said first frame means and said second frame means;

D. a first frame wheel means including at least two individual first frame wheels each being rotatably mounted with respect to said first frame means at spatially separated positions to facilitate guiding movement of said object means through said pneumatic track means and through said air tunnel means; and E. a second frame wheel means including at least two individual second frame wheels each being rotatably mounted with respect to said second frame means at spatially separated positions to facilitate guiding movement of said object means through said pneumatic track means and through said air tunnel means.

15. A pneumatic propulsion track apparatus as defined in claim 14 wherein said frame suspension means comprises a spring means.

16. A pneumatic propulsion track apparatus as defined in claim 14 wherein said first frame wheel means includes four individual first frame wheels each being rotatably mounted with respect to said first frame means at spatially separated positions to facilitate guiding movement of said object means through said pneumatic track means and through said air tunnel means and wherein said second frame wheel means including four second frame wheels each being rotatably mounted with respect to said second frame means at spatially separated positions to facilitate guiding movement of said object means through said pneumatic track means and through said air tunnel means.

17. A pneumatic propulsion track apparatus as defined in claim 14 wherein said pneumatic track means defines a track air relief means to allow excess air flow pressure within said pneumatic track means to be expelled therefrom and wherein said track air relief means comprising a seven longitudinal slot means defined in said pneumatic track means extending longitudinally approximately parallel to said pneumatic track means at a position adjacent said starting end means thereof, said longitudinal slot means being seven in number in order to minimize interaction with respect to the four wheel means included in said object means.

18. A pneumatic propulsion track apparatus as defined in claim 1 wherein said object means includes a decorative body means to simulate a specific design for aesthetic purposes.

19. A pneumatic propulsion track apparatus as defined in claim 1 wherein said air control housing defines an air recycling chamber means therewithin and wherein said air tunnel means includes an air recycling orifice means therein, said air recycling chamber means being in fluid flow communication with respect to said air recycling orifice means to receive air flow pressure therefrom.

20. A pneumatic propulsion track apparatus as defined in claim 19 wherein said air control housing includes an air recycling conduit means extending from said air recycling chamber means to said blower inlet means to allow air flow from said air recycling orifice means to flow into said air recycling chamber means and on through said air recycling conduit means to said blower inlet means.

21. A pneumatic propulsion track apparatus as defined in claim 20 wherein said air tunnel means includes an inwardly tapered surface area immediately upstream from said air recycling orifice means to urge an object means passing therethrough to move toward the center of said air tunnel means as it passes by said air recycling orifice means to minimize contact therewith.

22. A pneumatic propulsion track apparatus comprising:

A. an object means for movement along the propulsion track apparatus;

B. a pneumatic track means extending longitudinally from a starting end means to a terminating end means and providing a path for movement of said object means therealong, said pneumatic track means comprising an enclosed pneumatic conduit, said pneumatic track means defining a track air relief means to allow excess air flow pressure within said pneumatic track means to be expelled therefrom;

C. an air control means connected to said pneumatic track means for supplying of pressurized air thereinto in a controlled manner to urge movement of said object means therealong, said air control means comprising:

(1) an air control housing means;

(2) a track inlet means defined in said air control housing means and connected with respect to said terminating end means of said pneumatic track means to be in fluid flow communication therewith;

(3) a track outlet means defined in said air control housing means spatially disposed from said track inlet means and connected with respect to said starting end of said pneumatic track means to be in fluid flow communication therewith;

(4) an air tunnel means extending from said track inlet means to said track outlet means for maintaining fluid flow communication therebetween within said air control housing means to allow said object means to move from said track inlet means to said track outlet means and through said pneumatic track means, said air tunnel means includes an air recycling orifice means therein;

(5) an entrance opening means defined in said air control housing means to facilitate introduction of said object means into said air tunnel means and into said pneumatic track means;

(6) an entrance conduit means extending from said entrance opening means to said air tunnel means to facilitate movement of said object means into said air tunnel means and into said pneumatic track means;

(7) a blower chamber means defined within said air control housing and defining a blower inlet means and a blower outlet means;

(8) a blower means positioned within said blower chamber means and adapted to draw air into said blower chamber means through said blower inlet means and to expel air outwardly therefrom through said blower outlet means;

(9) an air pressure chamber means in fluid flow communication with respect to said blower outlet means of said blower chamber means to facilitate receiving of air under pressure from said blower means thereinto, said air pressure chamber means being positioned extending around said air tunnel means;

(10) a directional flow tapered air inlet means defined in said air tunnel means at a position within said air pressure chamber means, said directional flow tapered air inlet means being inclined from said track inlet means toward said track outlet means for introducing of pressurized air therethrough into said air tunnel means to facilitate propelling of said object means therethrough in a direction from said track inlet means toward said track outlet means and urging movement of said object means along said pneumatic track means from said starting end means of said pneumatic track means to said terminating end means thereof, said directional flow tapered air inlet means comprising:

a. a first angular tapered edge being circular in shape defined on said air tunnel means;

b. a second angular tapered edge being circular in shape and defined on said air tunnel means spatially disposed from said first angular tapered edge to define an annulus means therebetween inclined in the direction of movement of said object means therethrough from said track inlet means toward said track outlet means to facilitate propulsion thereof along said air tunnel means;

(11) a pressure release valve means extending from said air pressure chamber means to the external ambient environment to facilitate exhausting of air from within said air pressure chamber means, said pressure release valve means comprising a one-way valve means responsive to allow air only to exit from said air pressure chamber means, said pressure release valve being adjustable to control the exhausting of air therefrom to provide a level of throttle control during movement of said object means through said pneumatic track means, said pressure release valve being adjustable to control the exhausting of air therefrom to provide a level of throttle control during movement of said object means through said pneumatic track means;

(12) air recycling means comprising:

a. an air recycling chamber means defined within said air control housing in fluid flow communication with respect to said air recycling orifice means in said air tunnel means to receive air flow pressure therefrom;

b. an air recycling conduit means extending from said air recycling chamber means to said blower inlet means to allow air flow under pressure from said air recycling orifice means flowing into said air recycling chamber means to move on through said air recycling conduit means to said blower inlet means for recycling thereof; and D. a switching means attached with respect to said track outlet means of said air control housing and attached with respect to said starting end means of said pneumatic track means, said switching means movable between at least one recirculating position allow said object means to recirculate through said pneumatic track means and an exiting position allowing said object means to exit from said pneumatic track means.

23. A pneumatic propulsion track apparatus comprising:

A. an object means for movement along the propulsion track apparatus and comprising;

(1) a first frame means;

(2) a second frame means spatially disposed from said first frame means;

(3) a frame suspension means secured fixedly with respect to said first frame means and said second frame means for maintaining spatial separation therebetween, said frame suspension means comprising a spring of flexibly resilient material to facilitate flexibly resilient relative movement between said first frame means and said second frame means;

(4) a first frame wheel means including four individual first frame wheels each being rotatably mounted with respect to said first frame means at spatially separated positions to facilitate guiding movement of said object means through said pneumatic track means and through said air tunnel means;

(5) a second frame wheel means including four individual second frame wheels each being rotatably mounted with respect to said second frame means at spatially separated positions to facilitate guiding movement of said object means through said pneumatic track means and through said air tunnel means;

B. a pneumatic track means extending longitudinally from a starting end means to a terminating end means and providing a path for movement of said object means therealong, said pneumatic track means comprising an enclosed pneumatic conduit, said pneumatic track means defining a track air relief means to allow excess air flow pressure within said pneumatic track means to be expelled therefrom, said track air relief means including a plurality of longitudinal slot means defined in said pneumatic track means extending longitudinally approximately parallel to said pneumatic track means at a position adjacent said starting end means thereof, said pneumatic track means including:

(1) at least two individual track sections connected in parallel with respect to one another;

(2) at least one y-section positioned immediately upstream of said terminating end means of said pneumatic track means to urge movement of said object means to said track inlet means responsive to movement thereof through any of said individual track sections;

C. an air control means connected to said pneumatic track means for supplying of pressurized air thereinto in a controlled manner to urge movement of said object means therealong, said air control means comprising:

(1) an air control housing means;

(2) a track inlet means defined in said air control housing means and connected with respect to said terminating end means of said pneumatic track means to be in fluid flow communication therewith;

(3) a track outlet means defined in said air control housing means spatially disposed from said track inlet means and connected with respect to said starting end of said pneumatic track means to be in fluid flow communication therewith;

(4) an air tunnel means extending from said track inlet means to said track outlet means for maintaining fluid flow communication therebetween within said air control housing means to allow said object means to move from said track inlet means to said track outlet means and through said pneumatic track means, said air tunnel means includes an air recycling orifice means therein, said air tunnel means further including an inwardly tapered surface area immediately upstream from said air recycling orifice means to urge an object means passing therethrough to move toward the center of said air tunnel means as it passes by said air recycling orifice means to minimize contact and interaction therewith;

(5) an entrance opening means defined in said air control housing means to facilitate introduction of said object means into said air tunnel means and into said pneumatic track means;

(6) an entrance conduit means extending from said entrance opening means to said air tunnel means to facilitate movement of said object means into said air tunnel means and into said pneumatic track means;

(7) a blower chamber means defined within said air control housing and defining a blower inlet means and a blower outlet means;

(8) a blower means positioned within said blower chamber means and adapted to draw air into said blower chamber means through said blower inlet means and to expel air outwardly therefrom through said blower outlet means;

(9) an air pressure chamber means in fluid flow communication with respect to said blower outlet means of said blower chamber means to facilitate receiving of air under pressure from said blower means thereinto, said air pressure chamber means being positioned extending around said air tunnel means;

(10) a directional flow tapered air inlet means defined in said air tunnel means at a position within said air pressure chamber means, said directional flow tapered air inlet means being inclined from said track inlet means toward said track outlet means for introducing of pressurized air therethrough into said air tunnel means to facilitate propelling of said object means therethrough in a direction from said track inlet means toward said track outlet means and urging movement of said object means along said pneumatic track means from said starting end means of said pneumatic track means to said terminating end means thereof, said directional flow tapered air inlet means comprising:

a. a first angular tapered edge being circular in shape defined on said air tunnel means;

b. a second angular tapered edge being circular in shape and defined on said air tunnel means spatially disposed from said first angular tapered edge to define an annulus means therebetween inclined in the direction of movement of said object means therethrough from said track inlet means toward said track outlet means to facilitate propulsion thereof along said air tunnel means, said second angular tapered edge being movable relative to said first angular tapered edge to vary the size of said annulus means defined therebetween to vary air flow under pressure therethrough;

c. an outer sleeve means movably mounted with respect to said air tunnel means with said second angular tapered edge defined thereon and wherein the size of said annulus means is variable responsive to relative movement of said outer sleeve means with respect to said air tunnel means to control the magnitude of air flow therethrough;

(11) a pressure release valve means extending from said air pressure chamber means to the external ambient environment to facilitate exhausting of air pressure beyond a predetermined value to prevent excessive air pressure within said air pressure chamber means, said pressure release valve means comprising a one-way valve means responsive to allow air only to exit from said air pressure chamber means, said pressure release valve being adjustable to control the exhausting of air therefrom to provide a level of throttle control during movement of said object means through said pneumatic track means;

(12) air recycling means comprising:

a. an air recycling chamber means defined within said air control housing in fluid flow communication with respect to said air recycling orifice means in said air tunnel means to receive air flow pressure therefrom;

b. an air recycling conduit means extending from said air recycling chamber means to said blower inlet means to allow air flow under pressure from said air recycling orifice means flowing into said air recycling chamber means to move on through said air recycling conduit means to said blower inlet means for recycling thereof;

(13) an adjustable suction cap means extending over said blower inlet means to control the amount of air flow thereinto to control the amount of air under pressure entering said air pressure chamber means responsive to various different configurations of said pneumatic track means;

(14) a removable cap member positionable detachably over said entrance opening means for selectively sealing thereof to prevent flow of air inwardly therethrough after introduction of an object means therethrough into said air tunnel means, said removable cap member being responsive to excess air flow pressure within said air pressure chamber means to allow air flow leakage outwardly therepast from said air pressure chamber means and to relieve excess back pressure therepast; and D. a switching means attached with respect to said track outlet means of said air control housing and attached with respect to said starting end means of said pneumatic track means, said switching means movable between at least one recirculating position allowing said object means to recirculate through said pneumatic track means and an exiting position allowing said object means to exit from said pneumatic track means, said switching means including at least two recirculating positions to facilitate recirculating movement of said object means through more than one of said individual track sections of said pneumatic track means.

* * * * *